US007601192B2

(12) United States Patent
Boulay et al.

(10) Patent No.: US 7,601,192 B2
(45) Date of Patent: Oct. 13, 2009

(54) RECIRCULATION FILTER

(75) Inventors: Daniel A. Boulay, Middletown, DE (US); Edwin G. Dauber, Chesapeake City, MD (US); Kumud Goyal, Hockessin, DE (US); Nikhil Miraj, Newark, DE (US); William R. Moyer, Galena, MD (US); Xiao-Chun (Sean) Lu, Newark, DE (US)

(73) Assignee: Gore Enterprise Holdings, Inc., Newark, DE (US)

( * ) Notice: Subject to any disclaimer, the term of this patent is extended or adjusted under 35 U.S.C. 154(b) by 277 days.

(21) Appl. No.: 11/448,937

(22) Filed: Jun. 7, 2006

(65) Prior Publication Data

US 2007/0283809 A1 Dec. 13, 2007

(51) Int. Cl.
*B03C 3/28* (2006.01)

(52) U.S. Cl. ..... 55/385.6; 55/486; 55/528; 55/DIG. 39; 96/69; 360/97.02

(58) Field of Classification Search ..... 55/385.6, 55/486, 527, 528, DIG. 5, DIG. 39; 96/66, 96/68, 69; 360/97.02
See application file for complete search history.

(56) References Cited

U.S. PATENT DOCUMENTS

| | | | | |
|---|---|---|---|---|
| 3,307,332 | A | 3/1967 | Grace et al. | |
| 4,902,423 | A | 2/1990 | Bacino | 210/500.36 |
| 4,985,296 | A | 1/1991 | Mortimer, Jr. | 428/220 |
| 5,037,455 | A | 8/1991 | Scheineson et al. | |
| 5,384,337 | A | 1/1995 | Budinger | |
| 5,597,645 | A * | 1/1997 | Pike et al. | 96/99 |
| 6,119,691 | A * | 9/2000 | Angadjivand et al. | 128/206.19 |
| 6,238,466 | B1 * | 5/2001 | Rousseau et al. | 96/15 |
| 6,296,691 | B1 * | 10/2001 | Gidumal | 96/17 |
| 6,524,360 | B2 * | 2/2003 | Cox et al. | 55/382 |
| 7,318,859 | B2 * | 1/2008 | Ball et al. | 96/121 |
| 7,367,997 | B1 * | 5/2008 | Isogawa | 55/385.6 |
| 2004/0144255 | A1 * | 7/2004 | Lersch et al. | 96/69 |
| 2004/0231518 | A1 * | 11/2004 | Johnson et al. | 96/134 |
| 2006/0272507 | A1 * | 12/2006 | Johnson | 96/134 |

OTHER PUBLICATIONS

Pergamon Press, 1993, R.C. Brown "Air Filtration, An Integrated Approach to the Theory and Applications of Fibrous Filters" pp. 9, 162, 163, 245 and 250.

* cited by examiner

*Primary Examiner*—Richard L Chiesa
(74) *Attorney, Agent, or Firm*—Richard W. Ellis

(57) ABSTRACT

The invention relates to an improved electrostatic filter and filter media for filtering contaminants, such as particulates and vapor phase contaminants, from a confined environment such as electronic or optical devices susceptible to contamination (e.g. computer disk drives) by providing an improved performance recirculation filter.

14 Claims, 2 Drawing Sheets

RECIRCULATION FILTER

BACKGROUND OF THE INVENTION

Many enclosures that contain sensitive instrumentation must maintain very clean environments in order for the equipment to operate properly. Examples include enclosures with optical surfaces or electronic connections that are sensitive to particles and gaseous contaminants which can interfere with mechanical, optical, or electrical operation. Other examples include data recording devices such as computer hard disk drives that are sensitive to particles, organic vapors, and corrosive vapors. Still others include enclosures for processing, transporting or storing thin films and semiconductor wafers. Also included are electronic control boxes such as those used in automobiles and industrial applications that can be sensitive to particles, moisture buildup, and corrosion as well as contamination from fluids and vapors. Contamination in such enclosures originates from both inside and outside the enclosures. For example, in computer hard drives, damage may result from external contaminates as well as from particles and outgassing generated from internal sources. The terms "hard drives" or "hard disk drives" or "disk drives" or "drives" will be used herein for convenience and are understood to include any of the enclosures mentioned above.

To address contamination problems, internal particulate filters, or recirculation filters, are installed in disk drives. These filters may incorporate filter media, such as expanded PTFE membrane laminated to backing material such as a polyester nonwoven, or "pillow-shaped" filters containing electret (i.e., electrostatic) filter media or triboelectret media. Electret and triboelectret media are collectively described herein as "electret media". They may be pressure fit into slots or "C"-shaped channels and placed into the active air stream such as near the rotating disks in a computer hard disk drive or in front of a fan in electronic control cabinets, etc. These filters may have cover layers to contain fibers, increase stiffness, and generally improve handling or usability of the filter. Alternatively, the recirculation filter media can be framed in a plastic frame.

Recirculation filters for computer hard disk drives may also consist of a layer of electret media with one or more layers of scrim on either side of the electret layer. The outer scrim layer or layers are used to contain the fibers of the electret layer as well as add stiffness for ease of handling, weldability and the like.

Filter performance has been known to be a function of filter material weight. Higher weight per square meter materials have both a higher efficiency and a higher pressure drop. Electret filter layers are often specified by two parameters: the weight per unit area of electret fibers needled into a scrim, and the weight of the scrim. A typical scrim weight is 15 grams per square meter, but others are available. Common electret media weights may be from about 70 grams per square meter to about 90 grams per square meter, although other material weights are available. Other electret layers may be scrimless electret layers or entangled electret fibers.

One theory used to predict filter performance is Quality Factor. Quality Factor is described in *Air Filtration* by R. C. Brown, Paragon Press, 1993. Quality Factor (Qf) is defined as:

$$Qf = -\ln(\text{penetration})/\text{pressure drop}$$

Penetration is defined as the ratio of particles passing through the media to the total number of challenge particles. The inventors have discovered that while penetration and pressure drop are important to filter performance, filter thickness is also unexpectedly important.

Accordingly, the present invention provides an improved electret recirculation filter that can better filter the air of particles to better prevent particle problems inside the drive and increase drive reliability.

SUMMARY

In one aspect, the invention provides a disk drive recirculation filter comprising electrostatic filter media, the electrostatic filter media having a felt basis density of less than 40 $kg/m^3$ and a maximum continuous thickness greater than 0.445 mm.

In another aspect, the invention provides a disk drive recirculation filter comprising electrostatic filter media, the electrostatic filter media having a felt basis density of less than 60 $kg/m^3$ and a maximum continuous thickness greater than 1.016 mm.

In yet another aspect the invention provides a disk drive recirculation filter comprising electrostatic filter media, the electrostatic filter media having a felt basis density of less than 75 $kg/m^3$ and a maximum continuous thickness greater than 1.270 mm.

In a further aspect, the invention provides a disk drive recirculation filter comprising electrostatic filter media, the electrostatic filter media having a felt basis density of less than 85 $kg/m^3$ and a maximum continuous thickness greater than 1.397 mm.

In a still further aspect, the invention provides a disk drive recirculation filter comprising electrostatic filter media, the electrostatic filter media having a felt basis density of less than 95 $kg/m^3$ and a maximum continuous thickness greater than 1.524 mm.

In another aspect, the invention provides a disk drive recirculation filter comprising at least two layers of electrostatic filter media, wherein at least one of said layers has a felt basis weight of less than 35 $g/m^2$ and the electrostatic filter media has a maximum continuous felt thickness greater than 0.445 mm.

In still another aspect, the invention provides a disk drive recirculation filter comprising at least two layers of electrostatic filter media, wherein at least one of said layers has a felt basis weight of less than 55 $g/m^2$ and the electrostatic filter media has a maximum continuous felt thickness greater than 0.50 mm.

In a still further aspect, the invention provides a disk drive recirculation filter comprising at least two layers of electrostatic filter media, wherein at least one of said layers has a felt basis weight of less than 75 $g/m^2$ and the electrostatic filter media has a maximum continuous felt thickness greater than 0.635 mm.

In another aspect, the invention provides a disk drive recirculation filter comprising at least two layers of electrostatic filter media, wherein at least one of said layers has a felt basis weight of less than 100 $g/m^2$ and the electrostatic filter media has a maximum continuous felt thickness greater than 0.70 mm.

In another aspect, the invention provides a disk drive recirculation filter comprising at least two layers of electrostatic filter media, wherein at lease one of said layers has a felt basis weight of less than 110 $g/m^2$ and the electrostatic filter media has a maximum continuous felt thickness greater than 0.76 mm.

In still another aspect, the invention provides a disk drive recirculation filter comprising at least two layers of electrostatic filter media, wherein at least one of said layers has a felt basis weight of less than 165 g/m$^2$ and the electrostatic filter media has a maximum continuous felt thickness greater than 1.27 mm.

In another aspect, the invention provides a disk drive recirculation filter comprising at least two layers of electrostatic filter media forming a continuous laminar relation.

In another aspect, the invention provides a disk drive recirculation filter comprising at least three layers of electrostatic filter media forming a continuous laminar relation.

In still another aspect, the invention provides a disk drive recirculation filter comprising at least one layer of electrostatic filter media with a maximum continuous felt thickness greater than 2.794 mm.

In a still further aspect, the invention provides a recirculation filter, the recirculation filter comprising an electrostatic filter layer comprising a plurality of electrostatic fibers; and a second electrostatic filter layer comprising a plurality of electrostatic fibers wherein said first electrostatic filter layer is in a continuous laminar relationship with the second electrostatic filter layer.

BRIEF DESCRIPTION OF THE DRAWINGS

The operation of the present invention should become apparent from the written description when considered in conjunction with the following drawings, in which.

DETAILED DESCRIPTION OF THE PREFERRED EMBODIMENTS

The present invention relates to a device for filtering particulates from a confined environment such as electronic or optical devices susceptible to contamination (e.g. computer disk drives). Specifically, the invention provides an improved recirculation filter for a disk drive. Improved filter effectiveness is demonstrated by improved particle clean-up time.

The inventors have discovered that the thickness of electret filter material affects filter performance in a manner not previously known. Specifically, thicker filter media unexpectedly provides improved performance and reduced clean up time. Thus, the invention described herein contemplates an increase in electret filter media depth, rather than an increase in filter media density, as has been traditionally suggested as a means to improve filter performance. In other words, the inventors have found unexpected improvement in filtration performance of electret media by increasing media depth, rather than increasing density or felt weight. Increasing filter depth, without a concurrent increase in filter media density may provide improvement in filter performance by increasing particle contact time or residence time in the filter.

The preferred embodiments of the present invention are now described in some detail with reference to the drawings. Like reference numbers represent like parts, layers and constructions.

Figure 1A:
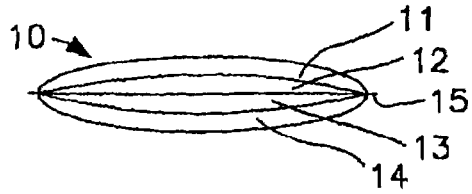
FIGS. 1A and 1B are a top and side view respectively of an embodiment of the filter unit of the present invention that comprises two layers of electrostatic media with cover scrims.
Figure 1B:
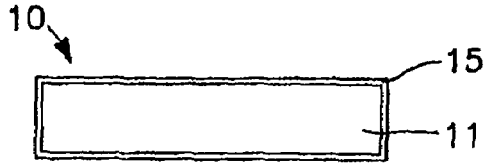

FIGS. 1A and 1B show a top and side view respectively of a first embodiment of an improved filter 10 of the present invention. FIG. 1A shows an improved filter 10 comprising two electrostatic filter media layers 12 and 13 with cover layers 11 and 14 with a perimeter seal 15 around the filter sealing all layers together. Electret layers 12 and 13 are shown in continuous laminar relation, having adjacent surfaces in substantially continuous contact, without intermediate materials or layers. The maximum continuous felt thickness is taken as the combined maximum thickness of layers 12 and 13. Felt basis weights for each layer of from 23 grams per square meter to 150 grams per square meter are preferred and felt layers having a basis weight in the range of 50 grams per square meter to 100 grams per square meter are more preferred. Layers 11 and 14 contain the fibers of the electrostatic media layers and add stiffness and handleabilty where required. These layers may comprise any scrim, screen, woven or nonwoven material or combination thereof. A preferred cover scrim is a point bonded spun bonded material such as a polypropylene. Such materials are commercially available from BBA Fiberweb Americas in Old Hickory, Tenn. in various material weights. A preferred cover scrim will contain fibers and add minimal pressure drop across the filter. Preferred weights of scrims may be 10 grams per square meter to 50 grams per square meter. Preferably, covering scrim material is about 20 grams per square meter to about 30 grams per square meter.

Figure 2A:
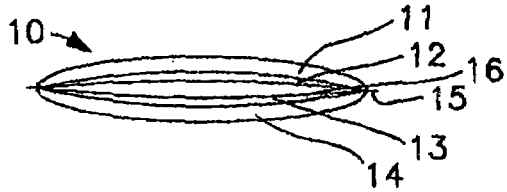
FIGS. 2A and 2B are a top and side view respectively of an embodiment of the filter unit of the present invention that comprises three layers of electrostatic media with cover scrims.
Figure 2B:
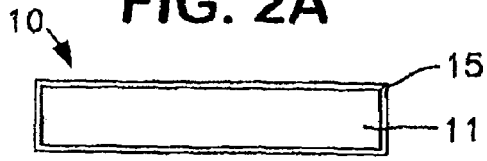

FIGS. 2A and 2B show a top and side view respectively of another embodiment of the improved filter 10 of the present invention. FIG. 2A shows three electrostatic filter media layers 12, 13, and 16 in continuous laminar relation. These materials as well as cover layers 11 and 14 are sealed continuously at the edge by perimeter seal 15. When using three layers, the increased electret material filter depth enables the use of relatively lighter weight electret media. Preferred electret felt weights for each layer are from about 20 grams per square meter to about 90 grams per square meter.

Figure 3A:
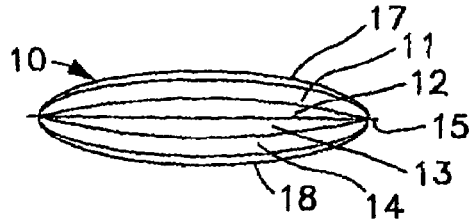
FIGS. 3A and 3B are a top and side view respectively of an embodiment of the filter unit of the present invention that comprises two layers of electrostatic filter media with two cover layers on either side of the filter layers.
Figure 3B:
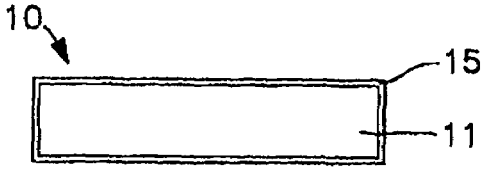

FIGS. 3A and 3B show a top and side view respectively of another embodiment of the improved filter 10 of the present invention. FIG. 3A shows two electrostatic filter media layers 12 and 13 with multiple cover layers 11, 14, 17, and 18. Additional cover layers 17 and 18 may permit the use of lighter, more permeable cover materials. If a second cover layer is used, a preferred material is a Delnet RB0707-30 expanded polypropylene material available from DelStar Technology, Inc., Middletown, Del.

Figure 4:
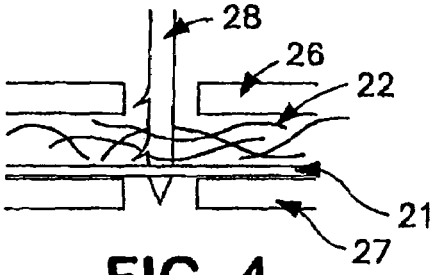
FIG. 4 is a side schematic view of a typical needle felting apparatus in which the staple fibers are needled into a scrim layer.

FIG. 4 shows a schematic side view of a typical needle felting apparatus. Needles 28 are punched through a fibrous layer of cut staple fibers 22 punching the staple fibers 22 through a scrim layer 21 to produce a felt. A stripper board 26 prevents the needles from pulling the fibers back out of the scrim on the return stroke. Bed board 27 is used to help the needles penetrate the scrim layer 21 with the staple fibers 22. Known needle felting processes are unidirectional, that is the needle penetrates the scrim layer from only one direction. In one aspect of the invention, however, fibers are needled with the scrim from both directions to create a thick felt.

Figure 5:
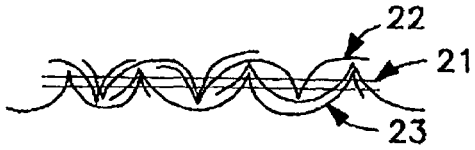
FIG. 5 is a side view of an embodiment of an electrostatic media of the present invention. It has staple fibers needled into a scrim layer from both directions.

FIG. 5 shows a side view of an embodiment of the improved filter layer of the present invention in which electret cut fibers 22 and 23 needled into the scrim 21 from both directions. The result is a single electret media layer with greater thickness. A fraction of the cut electret fibers, preferably about half, are needled into the scrim from one direction and the other fraction is needled into the scrim from the other direction. Any weight per square meter can be needled from both directions. Preferably the electret media is about 30 grams per square meter to about 300 grams per square meter. Most preferably the electret media is about 50 grams per square meter to about 200 grams per square meter.

Figure 6A:
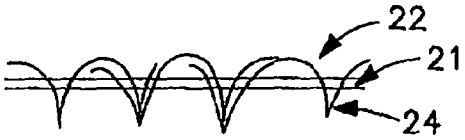
FIG. 6A is a side view of another embodiment of an electrostatic media of the present invention that has staple fibers needled into a scrim layer with an extended needling stoke to effect a thick electret felt.

FIG. 6A is a side view of another embodiment of the improved filter layer of the present invention with electret cut fibers 22 needled into a scrim 21. In this aspect it can be seen that the needle penetrates deeply into the scrim to points 24 to make a thick electret media layer. The length of the fibers and the weight of per square meter of the felt will depend upon the depth of needling stroke. Preferably, the electret media is about 30 gm per square meter to about 300 grams per square meter. More preferably the electret media is about 50 grams per square meter to about 200 grams per square meter.

Figure 6B:
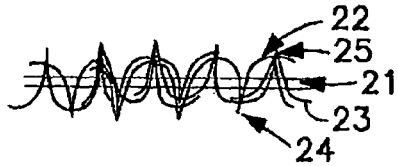
FIG. 6B is a side view of another embodiment of an electrostatic media of the present invention that has staple fibers needled into a scrim layer with an extended needling stroke from both directions.

FIG. 6B is a side view of another embodiment of the improved filter layer of the present invention with electret cut fibers 22 and 23 deeply needled from both sides of scrim 21 to points 24 and 25 respectively to construct a thick felt needled from both sides.

Other felting processes can be used to make a felt layer. Any process that entangles the electret fibers such as other mechanical entanglement methods can be used. Scrims can be used to hold and support the electret fibers or not. Multiple scrim layers can be used to hold the electret fibers into a uniform layer. Other means to hold the electret layers such as pressing them or bonding them together in bulk or as point patterned or nonpatterned bonds can also be used. The invention contemplates other means of making a fibrous electret layer or felt layer.

Figure 7:
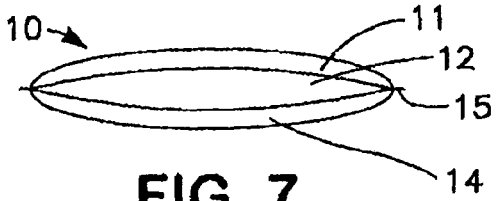
FIG. 7 is a side view of another embodiment of the filter unit of present invention comprising a single improved electrostatic filter layer similar to those shown in FIGS. 5, 6A and 6B.

FIG. 7 is a side view of another embodiment of the improved filter 10 of the present invention with a single electret layer 12 similar to those described and shown in FIGS. 5, 6A, and 6B. The felt layer has a maximum continuous thickness of at least 2.80 mm.

Figure 8:
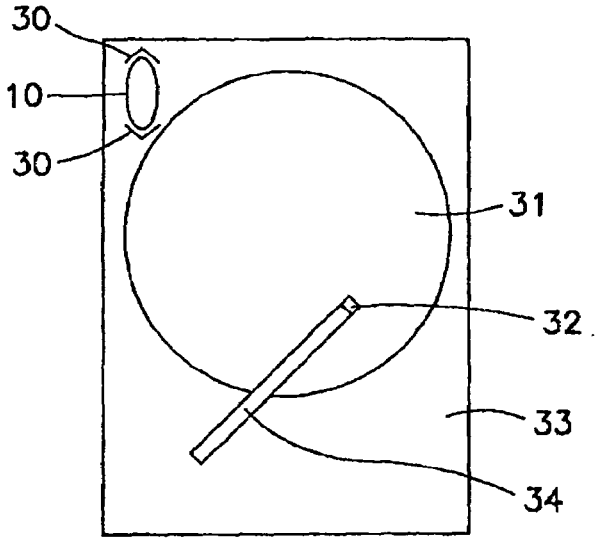
FIG. 8 is a top view of the filter unit of the present invention as it might be installed into a hard disk drive.

FIG. 8 illustrates how the improved filter 10 of present invention would be located inside a computer hard disk drive 33 by placing it between c-channels 30 or slots designed into the drive to accept and hold the recirculation filter. Other installations are possible. Some recirculation filters may also fit into plastic holders to hold the recirculation filter and perhaps other filtration or adsorbent parts into the drive. The magnetic storage disk 31 and read/write head 32 on armature 34 are also shown for reference.

An adsorbent layer or layers may be added to any of the embodiments described above, to make a combination filter effective for both particle and vapor filtration. The adsorbent can be treated for the adsorption of specific gaseous species such as acid gasses or not.

The adsorbent may comprise one or more layers of 100% adsorbent materials, such as granular activated carbon, or may be a filled product matrix such as a scaffold of porous polymeric material compounded with adsorbents that fill some of the void spaces. Other possibilities include adsorbent impregnated nonwoven materials or adsorbent beads disposed upon on a scrim where the non-woven or scrim may be cellulose or polymeric and may include latex or other binder or not. Still other possibilities include porous castings or adsorbent tablets and fillers that are polymeric or ceramic. The adsorbent may be a mixture of different types of adsorbents.

Examples of adsorbent materials that may be contained within the adsorbent layer include: physisorbers (e.g. silica gel, activated carbon, activated alumina, molecular sieves, adsorbent polymers, etc.); chemisorbers (e.g. potassium permanganate, potassium carbonate, potassium iodide, calcium carbonate, calcium sulfate, sodium carbonate, sodium hydroxide, calcium hydroxide, powdered metals or other reactants for scavenging gas phase contaminants); as well as mixtures of these materials. For some applications, it may be desirable to employ multiple layers of adsorbent materials, with each layer containing different adsorbents to selectively remove different contaminants.

A preferred embodiment of the adsorbent layer utilizes a sorbent filled PTFE sheet wherein the sorbent particles are entrapped within the reticular PTFE structure as taught by U.S. Pat. No. 4,985,296 issued to Mortimer, Jr. and specifically incorporated herein by reference. Preferably, particles are packed in a multi-modal (e.g. bi-modal or tri-modal) manner with particles of different sizes interspersed around one another to fill as much of the available void space between particles as is possible, so as to maximize the amount of active material contained in the core. This technique also allows a number of sorbents to be filled into a single layer. The core can then be expanded to allow some airflow or punctured by needling to allow more airflow. Expanding the core reduces loading density but offers a more uniform sorbent. Other processing, such as needling or the like, may be desirable to obtain the desired adsorbent and airflow performance.

The PTFE/adsorbent composite can be made in thicknesses from less than 0.001" to 0.400" and greater, allowing a great deal of flexibility in finished filter thickness and adsorbent loading. Additionally, sorbent densities approximating 80-95% of full density are possible with multi-model packing and physical compression, so that maximum adsorbent material can be packed per unit volume. The use of PTFE as the binding element also does not block the adsorbent pores as do binders such as acrylics, melted plastic resins, etc.

Additional layers may be added to filters for dimensional stability, fiber containment, filter stiffness, visual enhancements for visual verification of placement, ease of handling the filter robotically for automated installation. Additional filtration layers may also be added to enhance either the filtration for certain particles or used as filtration functional covers, scrims and support layers without departing from the spirit of the invention.

Membranes may also be utilized for filtration enhancement, fiber containment, or adsorbent containment in any of the embodiments. Membrane layers may be added as an extra layer or laminated to any of the other filter layers for inclusion.

A preferred membrane to use on a laminated construction of the present invention is a membrane layer of expanded PTFE membrane made as described in U.S. Pat. No. 4,902,423 to Bacino et al. This membrane has minimal resistance to airflow yet contains fibers well when laminated to a filter or support layer. This membrane also offers additional mechanical filtration in addition to the dominant electrostatic filtration mechanism of the electrostatic layer or layers contained in the filter of the present invention. This can become important when particles become difficult to collect with an electrostatic filter media such as when particles are traveling very fast or are of a size and charge that is difficult for electrostatic filter to collect. Such membranes are available in finished form from W. L. Gore and Associates, Inc. in Elkton, Md.

EXAMPLES

The recirculation filter effectiveness of the inventive recirculation filters and media were evaluated and compared to a conventional recirculation filters and conventional media. The sample filters were constructed in several thicknesses and felt weights which are set forth in Table 1 below. Each inventive filter was comprised of at least two electret filter media layers in continuous laminar relation. Each layer consisted of a 15 gram per square meter scrim with electret felt material needled through it (commercially available from Hollingsworth and Vose Company in Walpole, Mass.). The electret media was an approximate blend of 50% polypropylene and 50% acrylic cut staple fibers needled into the scrim. The electret media was not covered by cover layers but tested as felt layers only. All samples measured 16.0 mm high by 16.0 mm wide.

TABLE 1

| | Wt/Area/ Layers (g/m2) | Number of Layers | Total Nominal Felt wt/Area (g/m2) | Felt Density (kg/m3) | Felt Thickness (mm) | Thickness Density Ratio (m4/kg) |
|---|---|---|---|---|---|---|
| Comparative Example 1 | 30 | 1 | 30 | 46.81 | 0.615 | 12.600 |
| Comparative Example 2 | 50 | 1 | 50 | 60.94 | 0.820 | 13.456 |
| Comparative Example 3 | 70 | 1 | 70 | 67.22 | 1.041 | 15.486 |
| Comparative Example 4 | 90 | 1 | 90 | 82.40 | 1.092 | 13.252 |
| Inventive Example 5 | 30 | 2 | 60 | 48.81 | 1.229 | 25.179 |
| Inventive Example 6 | 50 | 2 | 100 | 60.94 | 1.641 | 26.928 |
| Inventive Example 7 | 70 | 2 | 140 | 67.22 | 2.083 | 30.987 |
| Inventive Example 8 | 30 | 3 | 90 | 48.81 | 1.844 | 37.779 |
| Inventive Example 9 | 90 | 2 | 180 | 82.40 | 2.184 | 26.505 |

Filter Thickness was measured using a Mitutoyo Thickness Gauge Serial number 00318 and model number ID-C1012CE with a 0.375" pressure foot with a 0.5 psi pressure. The thickness is taken as the maximum thickness, which typically is in the center of the filter. The Filter felt weights per area are vendor supplied averages and the thicknesses listed are an average value of five (5) samples.

Comparative Examples 1 through 4 are standard electret media commercially available from Hollingsworth and Vose and were single layer felts. The inventive filter media (Inventive Example 5 through Inventive Example 9) each have multiple layers of electret media in a laminar relation to form a continuous electret media thickness. As used herein, continuous electret media thickness includes not only the maximum thickness of a single layer of electret media, but also, with respect to multiple layers in a laminar relation to one another, the maximum aggregate thickness of all adjacent layers. The filter media was tested using the Disk Drive Recirculation Filter Test described herein. A no filter test was run as a control. The results are reported in Table 2 below.

TABLE 2

| Sample | Clean-Up Time (Sec.) | Relative Cleanup Ratio |
|---|---|---|
| No Filter | 53 | |
| Comparative Example 1 | 19.8 | 0.374 |

TABLE 2-continued

| Sample | Clean-Up Time (Sec.) | Relative Cleanup Ratio |
|---|---|---|
| Comparative Example 2 | 13.5 | 0.255 |
| Comparative Example 3 | 14 | 0.264 |
| Comparative Example 4 | 14 | 0.264 |
| Inventive Example 5 | 15.6 | 0.294 |
| Inventive Example 6 | 11.4 | 0.215 |
| Inventive Example 7 | 11.9 | 0.224 |
| Inventive Example 8 | 10.9 | 0.206 |
| Inventive Example 9 | 10.4 | 0.196 |

The improved recirculation filters showed significant performance improvement over known electret media constructions. The filter media of Inventive Example 8 showed an improved performance over Comparative Example 4 of 22.1%. Both filters have approximately the same electret media felt weight per area, but the increased thickness provided markedly better performance. Furthermore, double layer Inventive Example 9 shows a 25.7% improvement over single layer Comparative Example 4. As shown in Table 3, the Quality Factor for both media is the same and would thus predict equal performance, yet Inventive Example 9 clearly outperforms Comparative Example 4.

TABLE 3

| Sample | Penetration Fraction (0.26 microns @ 0.053 m/s) | Resistance (mm H20 @ 0.053 m/sec) | Clean Up Time (Sec.) | Quality Factor |
|---|---|---|---|---|
| Comparative Example 1 | 0.346 | 0.10 | 19.8 | 10.79 |
| Comparative Example 2 | 0.220 | 0.24 | 13.5 | 6.31 |
| Comparative Example 3 | 0.140 | 0.31 | 14.0 | 6.34 |
| Comparative Example 4 | 0.100 | 0.38 | 14.0 | 6.06 |
| Inventive Example 5 | 0.116 | 0.20 | 15.6 | 10.77 |
| Inventive Example 6 | 0.048 | 0.48 | 11.4 | 6.33 |
| Inventive Example 7 | 0.020 | 0.62 | 11.9 | 6.31 |
| Inventive Example 8 | 0.039 | 0.30 | 10.9 | 10.81 |
| Inventive Example 9 | 0.010 | 0.76 | 10.4 | 6.06 |

The multiple filter media layers of Inventive Example 6 above were incorporated into a recirculation filter with cover scrims to improve fiber containment. Cover layers were made with Toyobo 3201 available from Toyobo America, Inc. in New York, N.Y. This filter was tested and compared to the standard filter as received with the drive and the results are reported in Table 4. The standard filter included a 90 g/m$^2$ electret media, covered by nonwoven and scrim covering layers.

TABLE 4

| Sample | Clean-up Time | Relative Clean Up Ratio |
|---|---|---|
| No Filter | 53 | |
| Std. Filter | 19.3 | 0.364 |
| Example 2 | 13.8 | 0.260 |

The improved filter of the present invention had better clean-up time and Relative Cleanup Ratio ("RCUR") values than the existing filter and showed an improvement of 28.5%

The inventive filter layers of Inventive Example 6 above, was also constructed into a recirculation filter with two scrims on either side of the filtration layers. The standard filter had a total thickness of 0.874 mm. The inner cover was a Reemay 2004 from BBA Fiberweb in Old Hickory, Tenn. The outer scrim was a layer of Delnet RB0707-30 from Delstar in Middletown, Del. The filter was tested against the existing filter as supplied in the drive and the results are contained in Table 5.

TABLE 5

| Sample | Clean-up Time | Relative Cleanup Ratio |
|---|---|---|
| No Filter | 53 | |
| Std. Filter | 19.3 | 0.364 |
| Example 3 | 16.1 | 0.304 |

The improved filter of the present invention had better clean-up times and RCUR values than the standard filter and showed an improvement of 16.6%.

Disk Drive Recirculation Filter Test:

This test is designed to measure the effectiveness of a particle filter in reducing the particle concentration inside a disk drive from an initial state in which the drive has been charged with particles. The test used herein is one of two tests recommended by International Disk Drive Equipment and Materials Association for testing and comparing the performance for recirculation filter clean-up time in hard disk drives. The performance of the recirculation filter is quantified in terms of a cleanup time, which is defined as the time required to reduce the particle counts inside the drive to a fixed percentage of their initial value. A typical metric is the time it takes to clean up 90% of the particles in a drive and is referred to as a $t_{90}$ value. Lower $t_{90}$ values indicate faster clean up and improved filter performance.

To test the effectiveness of the recirculation filter, the filter samples were tested in the 3.5 inch form factor single disk drive from Western Digital Corporation model number WES-WD800JB. Modification consisted of drilling two holes in the drive lid. One hole was used to allow the introduction of particles, and another to sample the internal drive atmosphere during the performance testing. Installed over each of the holes in the lid was a stainless steel fitting, the fittings were centered, one over each hole and attached and sealed using two-component epoxy. The existing breather hole in the drive was left uncovered in order to provide a means for venting any overpressure from the drive and to allow air to enter the drive during periods when the drive environment was being sampled without air being purposefully introduced into the drive. The lid was fastened securely to the baseplate. Tubing was used to connect the particle supply source to the drive inlet fitting and to connect the particle counter to the outlet fitting. The drive lid was cleaned using isopropanol and clean pressurized air to remove any oils and particles created during modification. Following modification of the drive, the filters were placed into the c-channels in the location as designed in the drive. A comparison was made with the existing recirculation filter as supplied and received in the drive as purchased. Each sample was tested in the same 3.5" drive in the same recirculation filter location as designed into the drive. All filter samples were the same size and comparisons to the filter supplied in the drive are made.

A tube supplying an aerosol of 0.1 μm particles was connected to the inlet port in the drive lid upstream of the filter based on the direction of disk rotation. The particles were 0.1 μm polystyrene latex spheres supplied by Duke Scientific Corporation and they were diluted in deionized water and atomized with an atomizer supplied by TSI Corporation, Minneapolis, Minn. A second tube for sampling the internal atmosphere of the drive connected the laser particle counter (LPC) to the outlet port in the drive lid downstream of the filter. A Model HS-LAS laser aerosol spectrometer from Particle Measuring Systems Inc., in Boulder, Colo., was used to count the particles. Sample flow rate out of the drive and through the counter was maintained by precision mass flow controllers at 1.0 cc/sec and sheath flow through the LPC was maintained at 15 cc/sec. Counts of 0.1 μm particles were obtained once per second by the LPC and stored on a computer disk drive for later analysis. The test was performed with the drive located in a laminar flow hood fitted with a HEPA filter in the air intake, in order to maintain a controlled test environment with an extremely low ambient particle concentration. Samples of a standard sized and construction recirculation filter were used from the drive as purchased. A control containing no recirculation filters was also run.

The recirculation filter test consisted of the following sequence: With the drive turned on and the disks spinning, particle laden air was passed through the drive. The counts of 0.1 μm particles were monitored until a steady state count was achieved, typically around 1000 to 2000 counts per second. At that time (t=0) the particle laden air was turned off while sampling of the internal drive atmosphere continued. The concentration of 0.1 μm particles was again monitored until no more than 1% of the initial steady state counts remained. The time it takes to get to 10% of the initial steady state count or removal of 90% of the particles is referred to as $t_{90}$ and the time it takes to get to 1% of the initial steady state count or removal of 99% of the particles is referred to as $t_{99}$. The drop in concentration is due to the recirculation of air through the drive and particle collection on the filter, impaction of the particles on drive surfaces and other particle collection means. Different filter constructions and locations will have different impacts on both the initial steady state recorded when the drive is on and particles are being delivered to the drive as well as the time it takes to clean up the drive and these differences can be analyzed to determine optimal filter constructions and locations. When one filter location is used then different filter constructions can be tested and compared to see which one gives the best performance or the best or fastest clean up time.

At least two individual tests were performed in order to check reproducibility and eliminate error from noise in the background counts. The results from the tests were averaged to obtain the average cleanup times for 0.1 μm particles. Further analysis can calculate a RCUR time by dividing the $t_{90}$ time of the filter by the $t_{90}$ time of the no filter run to get a number referred to as the RCUR number or Relative Clean-Up Ratio. The RCUR number is a better comparative number between different drives and different test setups because it references a filter performance to a no filter performance in a particular drive being tested. In other words a drive with no filter will still eventually get the air clean. Air is sampled from the drive to the particle counter and make-up air enters through the breather filter in the drive and is thus filtered clean air. Also particles will impact on drive surfaces or eventually settle out of the air stream. So by comparing the clean-up time for the filter in a drive to the drive without a filter, the effect of the filter is better isolated, and different filters are able to be compared more easily. Faster filter clean-up is better performance so lower RCUR values also indicate better performance.

While particular embodiments of the present invention have been illustrated and described herein, the present invention should not be limited to such illustrations and descriptions. It should be apparent that changes and modifications may be incorporated and embodied as part of the present invention within the scope of the following claims:

We claim:

1. A disk drive recirculation filter comprising electrostatic media, said electrostatic media comprising at least two layers, at least one of said layers having a felt basis weight of less than 55 g/m$^2$ and a felt density, said electrostatic filter media having a maximum continuous felt thickness greater than 0.50 mm and wherein the ratio of continuous felt thickness to felt density is greater than 20.

2. A disk drive recirculation filter of claim 1, further comprising at least one layer of PTFE membrane in a laminar relation with the electrostatic filter media.

3. A disk drive recirculation filter comprising electrostatic media, said electrostatic media comprising at least two layers, at least one of said layers having a felt basis weight of less than 75 g/m$^2$ and a felt density, said electrostatic filter media having a maximum continuous felt thickness greater than 0.635 mm and wherein the ratio of continuous felt thickness to felt density is greater than 20.

4. A disk drive filter of claim 3, further comprising at least one layer of PTFE membrane in a laminar relation with the electrostatic filter media.

5. A disk drive recirculation filter comprising electrostatic media, said electrostatic media comprising at least two layers, at least one of said layers having a felt basis weight of less than 100 g/m$^2$ and a felt density, said electrostatic filter media having a maximum continuous felt thickness greater than 0.70 mm and wherein the ratio of continuous felt thickness to felt density is greater than 20.

6. A disk drive filter of claim 5, further comprising at least one layer of PTFE membrane in a laminar relation with the electrostatic filter media.

7. A disk drive recirculation filter comprising electrostatic media, said electrostatic media comprising at least two layers, at least one of said layers having a felt basis weight of less than 110 g/m$^2$ and a felt density, said electrostatic filter media with a maximum continuous felt thickness greater than 0.76 mm and wherein the ratio of continuous felt thickness to felt density is greater than 20.

8. A disk drive filter of claim 7, further comprising at least one layer of PTFE membrane in a laminar relation with the electrostatic filter media.

9. A disk drive recirculation filter comprising electrostatic media, said electrostatic media comprising at least two layers, at least one of said layers having a felt basis weight of less than 165 g/m$^2$ and a felt density, said electrostatic filter media having a maximum continuous felt thickness greater than 1.27 mm and wherein the ratio of continuous felt thickness to felt density is greater than 20.

10. A disk drive filter of claim 9, further comprising at least one layer of PTFE membrane in a laminar relation with the electrostatic filter media.

11. A disk drive recirculation filter for use within a disc drive, the recirculation filter comprising:

a) a first electrostatic filter layer comprising a plurality of electrostatic fibers having a first thickness; and b) a second electrostatic filter layer comprising a plurality of electrostatic fibers having a second felt thickness wherein said first electrostatic filter layer and said second electrostatic filter layer are in continuous laminar relation and form a electrostatic felt layer having a thickness and wherein the electrostatic felt layer has a density such that the ratio of thickness of the electrostatic felt layer to the density of the felt is greater than 20.

12. A disk drive recirculation filter of claim 11, further comprising one or more cover layers surrounding the electrostatic filter layers.

13. A disk drive recirculation filter of claim 11, further having a sealed edge around the perimeter of the filter.

14. A disk drive recirculation filter of claim 11, further comprising at least one layer of PTFE membrane in a laminar relation with the electrostatic filter media.

* * * * *